United States Patent [19]

Allegri, Sr.

[11] 4,372,394

[45] Feb. 8, 1983

[54] MAGNETICALLY DRIVEN PULVERIZER

[76] Inventor: Theodore H. Allegri, Sr., McLean, Va.

[21] Appl. No.: 218,696

[22] Filed: Dec. 22, 1980

[51] Int. Cl.[3] ..... A62C 11/00

[52] U.S. Cl. ..... 169/30; 366/273

[58] Field of Search ..... 169/30; 366/273, 274, 366/130; 241/98, 167, 169.1, 172

[56] References Cited

U.S. PATENT DOCUMENTS

| | | | |
|---|---|---|---|
| 1,060,419 | 4/1913 | Benjamin | 366/130 |
| 2,851,985 | 9/1958 | Keehn | 169/30 |
| 3,136,532 | 6/1964 | Rudnick | 366/130 |
| 3,168,294 | 2/1965 | Hasumura | 366/274 |
| 3,863,903 | 2/1975 | Brehmer et al. | 366/274 |
| 4,044,836 | 8/1977 | Martin et al. | 169/30 |

*Primary Examiner*—Stanley H. Tollberg
*Assistant Examiner*—Kenneth Noland
*Attorney, Agent, or Firm*—Kerkam, Stowell, Kondracki & Clarke

[57] ABSTRACT

This invention relates to a system for the prevention of caking or solidification of powdered and granular materials in fire extinguishers and other cylindrical or closed containers. Dry chemical fire extinguishers sometimes fail to function when the material contained in their cylindrical bodies solidifies and cannot be vented through the nozzle of the extinguisher. Fire extinguishers can be rendered more effective and failsafe by way of this invention since, by rapid rotation of a coil or other form or forms imbedded within the material, the material may be fluffed up and caking, solidification, or impactment from settlement may be eliminated thereby. Also, any contained powdered or granular material may be stirred by creating turbulence within the material by rotating a coiled steel form or other forms through the use of a magnetic force induced through the walls of the container.

17 Claims, 5 Drawing Figures

FIG 4
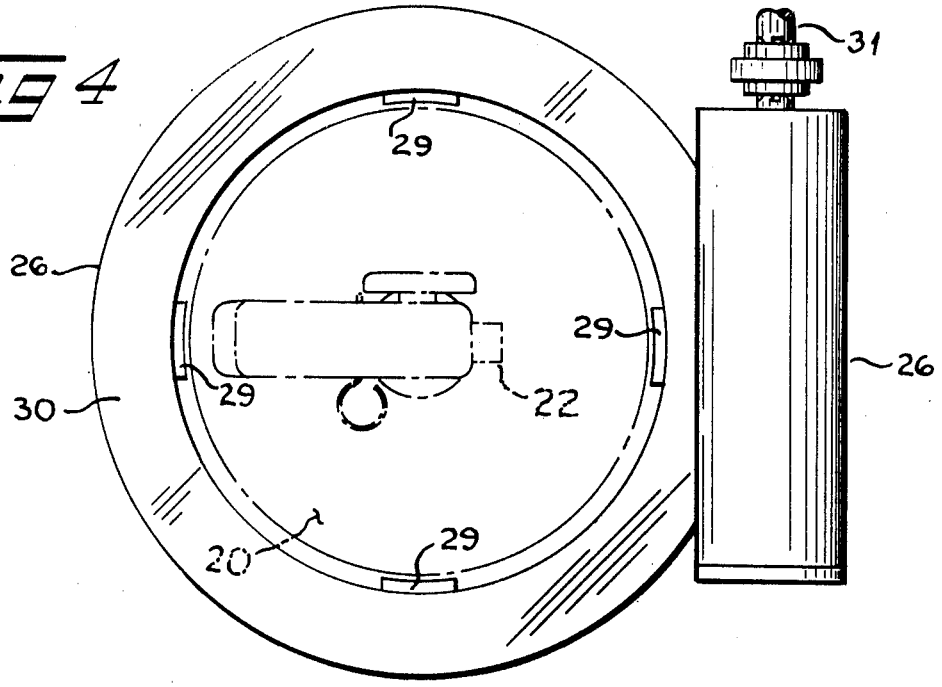
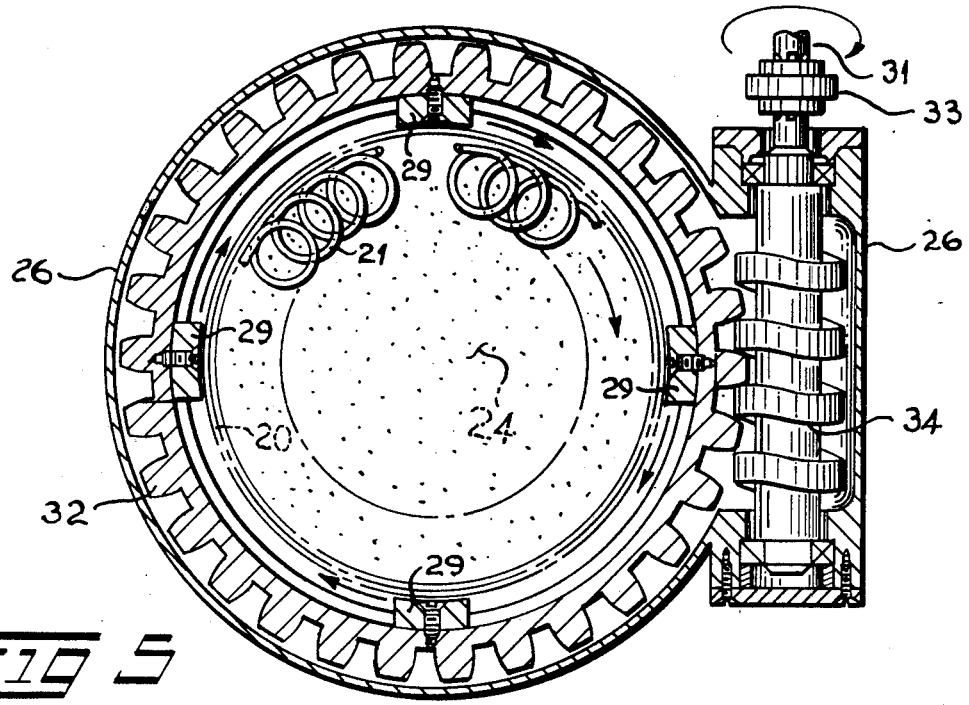
FIG 5

MAGNETICALLY DRIVEN PULVERIZER

SUMMARY OF THE INVENTION

This invention relates to the pulverization of compacted, solidified, or settled materials, such as chemical powders in fire extinguishers, or other materials contained in cylindrical bodies or other closed containers.

An object of this invention is to provide a coil which may be rotated within a fire extinguisher to create a turbulence within the dry chemical powder to fluff up the powder and make it more easily ventable through the extinguisher nozzle.

A further object of this invention is to provide a magnetic force which may be actuated externally from the body of the container in order to impact a rotating motion to a ferrous form within an enclosed container for the purpose of stirring the contents of the container.

Another object of the invention is to provide a positive means for insuring that the individual molecules of dry chemical powders within a fire extinguisher are sufficiently activated that they will not form a solidified mass that will militate against the successful functioning of the fire extinguisher.

Other objects and advantages of this invention will be apparent from the following detailed description, taken in connection with the accompanying drawings wherein I have shown the preferred form in which I have contemplated applying the principles of the invention.

Referring to the drawings:

FIG. 4 is a top elevational view of a fire extinguisher positioned in a magnetic driver.

FIG. 5 is a top sectional view of the magnetic driver, magnetic ring gear, and worm drive screw, and a partial top sectional view of a fire extinguisher cylinder with a coil being driven by the magnetic ring gear.

Figure 1:
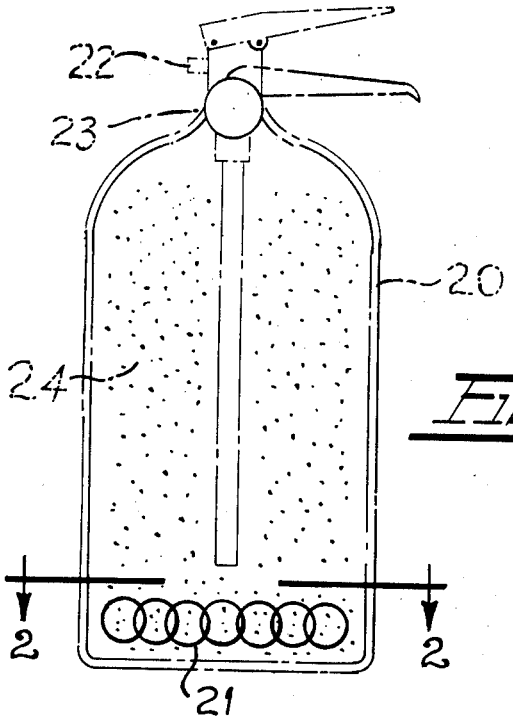
FIG. 1 is a side sectional view of a fire extinguisher with a wire coil at the bottom of the cylinder.

Referring to the drawings in detail and first particularly to FIG. 1:

FIG. 1 being a side sectional view showing a fire extinguisher cylinder 20 with a coil 21 a ferrous material having a plurality of individual loops positioned a the bottom of the fire extinguisher cylinder 20. The nozzle assembly 22 which is not a part of this invention is screwed into the throat 23 of the fire extinguisher cylinder 20 after the coil 21 a ferrous material is pushed through the throat 23 of the fire extinguisher cylinder 20, where it falls to the bottom and thereafter the dry chemical powder 24 is poured into the fire extinguisher cylinder 20. The nozzle assembly 22 is screwed back into the throat 23 and the fire extinguisher cylinder 20 may then be pressurized and ready for operation.

Figure 2:
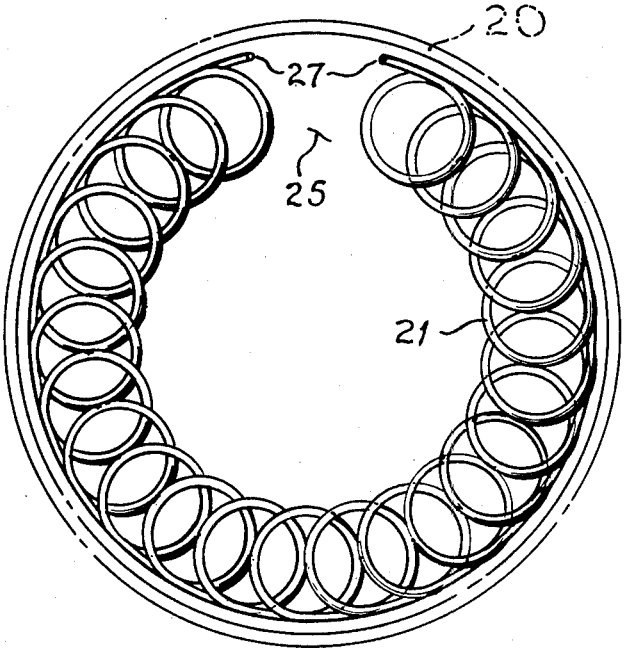
FIG. 2 is a top sectional view of a fire extinguisher cylinder with a coil in place.

FIG. 2 is a somewhat enlarged top sectional view of the fire extinguisher 20 shown in FIG. 1. This view shows the coil 21 with a gap 25 because it is not a continuous form, but is provided with two ends 27 which makes it possible to push the coil 21 through the throat 23 of the fire extinguisher cylinder 20 once the nozzle assembly 22 has been removed by unscrewing it.

Figure 3:
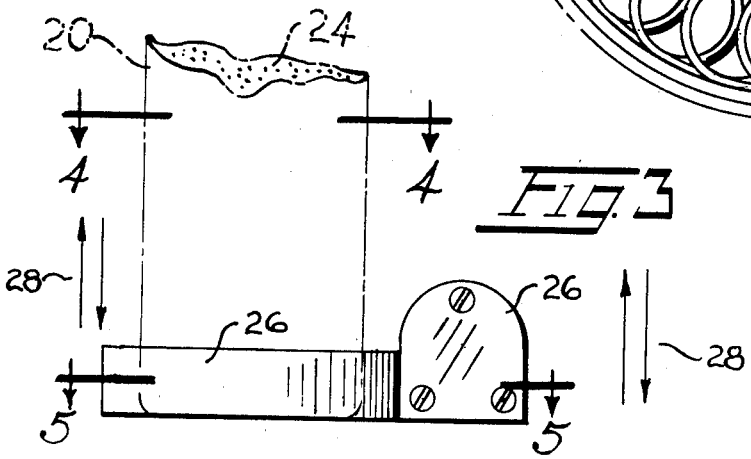
FIG. 3 is a partial side elevational view of a fire extinguisher cylinder positioned in a magnetic driver.

FIG. 3 is a partial side elevational view of the fire extinguisher cylinder 20 positioned in the magnetic driver 26. As indicated by the arrows 28 the magnetic driver 26 may be moved upwards and downwards along the length of the fire extinguisher cylinder 20, after the magnetic driver 26 is actuated, to establish a magnetic field in order to rotate the coil 21 by magnetic induction. Alternatively, since the outside diameter of container 20 is slightly less than the inside diameter of the magnetic driver, as more clearly shown in FIG. 5, the cylinder 20 may be moved relative to the magnetic driver along the longitudinal axis of the cylinder or container 20. The coil 21 is shown in FIG. 1 and FIG. 2 stirs up the dry chemical powder 24 thereby removing any compaction, or solidification which might interfere with the proper functioning of the fire extinguisher.

FIG. 4 is a top elevational view of the fire extinguisher cylinder 20 showing the nozzle assembly 22 and the magnetic driver 26. This view, also, shows the magnets 29 in the ring gear housing 30. A portion of the drive shaft 31 is, also, shown in this view.

FIG. 5 is a top sectional view of the magnetic driver 26, the magnetic ring gear 32 which holds the magnets 29 and rotates them by means of the rotation imparted by the drive shaft 31 acting through a coupling 33 and a worm gear 34. As the magnets 29 are rotated, the magnetomotive force penetrates through the walls of the fire extinguisher cylinder 20 and causes the coil 21 to rotate by induction, thus pulverizing the dry chemical powder 24 contained in the fire extinguisher 20. The views in FIG. 4 and FIG. 5 show a partial drive shaft 31. The drive shaft 31 may be rotated manually or by means of a flexible shaft connected to an electric motor. Neither the flexible shaft, nor the electric motor are shown since these components may be supplied by anyone skilled in the mechanical arts.

While specific forms of the invention have been described and illustrated herein, it is desired to be understood that the same may be varied within the scope of the appended claims, without departing from the spirit of the invention.

What is claimed is:

1. In combination with a fire extinguisher having a pressurized container including a throat portion at one end, and a nozzle assembly screwed into the throat portion, the improvement of a magnetically driven mixing means comprising a mixing element within said container adapted to be movable therein to mix the contents of the container in response to an externally generated magnetic field, means for generating said magnetic field, said means for generating said magnetic field including an annular ring member disposed about the container, said ring member being movable longitudinally relative to said container, said ring member having a plurality of horizontally spaced magnets affixed thereto and means for rotatably driving said annular ring member about said container.

2. The combination of claim 1 wherein said mixing element is movable internally along the length of the container in response to lengthwise movement of the ring member and rotatable therein in response to the generated magnetic field.

3. The combination of claim 1 wherein said mixing element is a coil member.

4. The combination of claim 3 wherein said coil member comprises a plurality of individual loops.

5. The combination of claim 3 wherein said coil member is non-continuous, having two spaced ends so as to be insertable into said container through the throat portion.

6. The combination of claim 5 wherein said ring member is a ring gear having an internal surface and an externally toothed outer surface, said magnets being mounted to the internal surface of the ring gear and said means for rotating said ring gear including a worm gear coupled to the externally toothed surface and having a drive shaft adapted to be coupled to an external rotatable driving force.

7. In combination with a fire extinguisher having a pressurized cylinder including a narrow throat portion at one end, a nozzle assembly screwed into the throat portion, the improvement of a magnetically driven mixing means comprising a rotatable mixing element within said cylinder adapted to be rotated therein to mix the contents of the container in response to an externally generated rotating magnetic field, means for generating said rotating magnetic field, said means for generating said rotating magnetic field including a rotatable annular ring member disposed about the cylinder to substantially receive the container, said ring member having a plurality of horizontally spaced magnets affixed thereto and means for rotating said annular ring member.

8. The combination of claim 7 wherein said mixing element is movable along the length of the cylinder in response to relative lengthwise movement of the cylinder to the ring member.

9. The combination of claim 7 wherein said mixing element is a ferrous member.

10. The combination of claim 9 wherein said ferrous member comprises a coil having plurality of individual loops.

11. The combination of claim 10 wherein said coil member is non-continuous, having two spaced ends and being insertable into said cylinder through the throat portion.

12. The combination of claim 11 wherein said ring member is a ring gear having an internal surface and an externally toothed outer surface, said magnets being mounted to the internal surface of the ring gear and said means for rotating said ring gear includes a worm gear coupled to the externally toothed surface and having a drive shaft adapted to be coupled to an external rotatable driving force.

13. A mixing device for mixing the contents of a closed container comprising a magnetically actuable mixing element disposed within the container and adapted to be movable therein along the length of the container and rotatable therein about the longitudinal axis of the container to mix the contents thereof in response to an externally generated magnetic field, means for generating said magnetic field, said means for generating said magnetic field including an annular ring member disposed about the container to substantially receive the container, said ring member having a plurality of horizontally spaced magnets affixed thereto and means for rotatably driving said annular ring member about said container.

14. A mixing device as set forth in claim 13 wherein said container has a narrowed closed off throat portion at one end and said mixing element is a non-continuous ferrous member.

15. A mixing device as set forth in claim 14 wherein said ferrous member is a coil comprises a plurality of individual loops.

16. The combination of claim 15 wherein said mixing element is movable along the length of the container in response to relative lengthwise movement between the ring member and the container and the magnetic coupling established there between.

17. The combination of claim 16 wherein said ring member is an externally toothed ring gear being rotatable about said container, said magnets being mounted to an internal surface of the ring gear and said means for moving said ring gear includes a worm gear coupled to the toothed gear and having a drive shaft adapted to be coupled to an external driving force to effect rotation of the ring gear about the container.

* * * * *